US006431646B1

(12) United States Patent
Longoria

(10) Patent No.: US 6,431,646 B1
(45) **Date of Patent: *Aug. 13, 2002**

(54) VIBRATOR/BOUNCER ATTACHMENT FOR INFANT SEATS

(75) Inventor: Jose P. Longoria, Miami, FL (US)

(73) Assignee: Summer Infant Products, Inc., Lincoln, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/627,432

(22) Filed: Jul. 27, 2000

Related U.S. Application Data

(63) Continuation-in-part of application No. 09/436,697, filed on Nov. 8, 1999.

(51) Int. Cl.[7] ..... A47C 7/62

(52) U.S. Cl. ..... 297/217.3; 297/217.4; 297/DIG. 4; 5/108; 5/109

(58) Field of Search ..... 297/217.3, 217.4, 297/DIG. 4; 5/108, 109

(56) References Cited

U.S. PATENT DOCUMENTS

| | | | |
|---|---|---|---|
| 3,235,306 | A | 2/1966 | Chernivsky |
| 4,141,095 | A | 2/1979 | Adachi |
| 4,985,949 | A | 1/1991 | Jantz |
| 5,107,555 | A | 4/1992 | Thrasher |
| 5,207,478 | A | 5/1993 | Freese et al. |
| 5,368,361 | A | 11/1994 | Wen-Ming |
| 5,411,315 | A | 5/1995 | Greenwood |
| 5,460,430 | A | 10/1995 | Miga, Jr. et al. |
| 5,503,458 | A | 4/1996 | Petrie |
| 5,509,721 | A | 4/1996 | Huang |
| 5,572,903 | A | 11/1996 | Lee |
| 5,860,698 | A | 1/1999 | Asenstorfer et al. |

*Primary Examiner*—Beth A. Stephan
*Assistant Examiner*—Dennis L. Dorsey
(74) *Attorney, Agent, or Firm*—John E. Reilly

(57) ABSTRACT

An infant seat assembly is made up of a resilient frame with a leg rest portion designed to support a displacement mechanism which will either impart a shaking or bouncing motion to the frame; and, when a baby is placed in the seat assembly, the frequency of vibration imparted to the frame can be selectively tuned to be in harmony with the natural frequency of vibration of the frame when an infant is placed in the seat assembly.

23 Claims, 4 Drawing Sheets

VIBRATOR/BOUNCER ATTACHMENT FOR INFANT SEATS

CROSS-REFERENCE TO RELATED APPLICATION

This application is a continuation-in-part of U.S. patent application Ser. No. 09/436,697, filed Nov. 8, 1999 now abandoned for BOUNCER SEAT AND DRIVE MECHANISM THEREFOR, by Jose P. Longoria and Melvin R. Kennedy and assigned to the assignee of the present invention.

BACKGROUND AND FIELD OF INVENTION

This invention relates to infant support devices and more particularly relates to a novel and improved displacement mechanism adapted for attachment to the resilient frame of an infant seat to selectively impart bouncing or vibratory action to the device.

We have previously devised a displacement mechanism for infant seats in which the displacement mechanism is mounted on the base portion and includes a variable speed motor drive which can be adjusted to tune the frequency of reciprocal motion of the base to the natural frequency of the seat for a particular weight baby and reference is made to the above-identified application for patent Ser. No. 09/436,697.

Other approaches have been taken to bouncing or rocker devices for infant seats and, for example, reference is made to U.S. Pat. No. 5,107,555 to M. L. Thrasher which discloses a crib rocking assembly having a mattress that rests on a plate which is connected to a rocking assembly that can move a mattress in a vertical direction. U.S. Pat. No. 4,985,949 to R. F. Jantz discloses an infant carrier seat rocker having a vertically oscillating lifter yoke. U.S. Pat. No. 5,860,698 to L. Asenstorfer et al discloses a rocker drive for child recliners with a musical clock that automatically operates when a rocker drive is activated. Other representative patents of interest in this field are U.S. Pat. No. 3,235,306 to V. A. Chernivsky, U.S. Pat. No. 4,141,095 to K. Adachi, U.S. Pat. No. 5,207,478 to T. B. Freese et al, U.S. Pat. No. 5,368,361 to C. Wen-Ming, U.S. Pat. No. 5,411,315 to M. H. Greenwood, U.S. Pat. No. 5,460,430 to C. W. Miga, Jr. et al, U.S. Pat. No. 5,503,458 to A. J. Petrie, U.S. Pat. No. 5,509,721 to L. C. Huang and U.S. Pat. No. 5,572,903 to Y. S. Lee.

In our prior device, emphasis was placed on physical displacement of a portion of the seat assembly such that the speed, frequency and distance of displacement could be controlled in relation to the weight of the infant. In accordance with the present invention, a similar result can be achieved by the suspension of an eccentric mass of one or more different selected weights on the infant seat in such a way as to impart relatively high frequency of vibration with a low amplitude of displacement or relatively low frequency of vibration with a high amplitude of displacement; and further to impart optimum vibration or bouncing to the seat which, in a simplified manner, can be tuned to the natural frequency of the seat according to the weight of the baby.

SUMMARY OF THE INVENTION

It is therefore an object of the present invention to provide for a novel and improved method and means for imparting bouncing or vibration, or a combination of selectively bouncing and vibration, to an infant seat.

It is another object of the present invention to provide for a novel and improved mechanism for selectively imparting bouncing to an infant seat which can be selectively tuned to the natural frequency of the seat according to the weight of a baby placed therein.

It is a further object of the present invention to provide for a novel and improved infant seat assembly in which the bouncing and/or vibration of the seat is greatly enhanced by mounting of the mechanism to the seat so as to be most sensitive to the weight of the baby.

An additional object of the present invention is to provide for a novel and improved mechanism for selectively bouncing or vibrating an infant seat for babies and for selectively shifting between high and low speed vibration in combination with high and low amplitude of displacement which is characterized by its simplicity, ease of manufacture and its conformability for use with different types of resilient frame infant seats.

In accordance with the present invention, there has been devised a novel seat-vibrating mechanism which is specifically adaptable for use with infant seats but nevertheless is also conformable for use with other resilient frame supports, such as, for example, a cot or bed. It is therefore desirable to provide a vibrational mechanism which is essentially stand-alone or self-contained so as to be attachable to various articles of furniture. In its application to an infant seat or other resilient frame support, the vibrational mechanism is drivingly connected to the frame and includes means for vertically reciprocating the frame to impart a vibrating motion thereto. Furthermore, in its preferred application, the vibrational mechanism is employed in association with a foot rest or other cantilever support portion rigidly connected to the resilient frame such that vibration is imparted via the cantilever support into the resilient frame. The vibrational mechanism and specifically the means for reciprocating or vibrating the resilient frame includes adjusting means for regulating the frequency of vibration of the frame whereby to tune it to the natural frequency of vibration of the frame depending upon the weight of the infant. When the vibrational mechanism is adjusted to match the natural frequency of the frame, with an infant in place, the amplitude of displacement is enhanced and the power necessary to maintain a given amount of displacement or motion is reduced. The vibrating mechanism is preferably comprised of motor drive means employed in association with one or more eccentric weights of different mass and shifter means for selectively connecting the motor drive means to one of the eccentric weight members. In order to adjust the frequency of vibration imparted to the frame, the adjusting means may take the form of a rheostat which is manually adjustable and regulates the speed of rotation of a motor drive shaft off of the motor drive means.

An additional feature of the present invention resides in the use of a step-down speed changer off of the motor drive to regulate the speed of rotation of a relatively lightweight eccentric mass to impart slight vibration to the frame. The shift means may be employed to alternatively connect the motor drive means into a relatively heavy weight eccentric mass mounted on a separate drive shaft with a speed reducer interposed between the motor drive means and the heavy weight mass so as to create a much lower frequency of vibration and higher amplitude of motion for a given speed of the motor.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
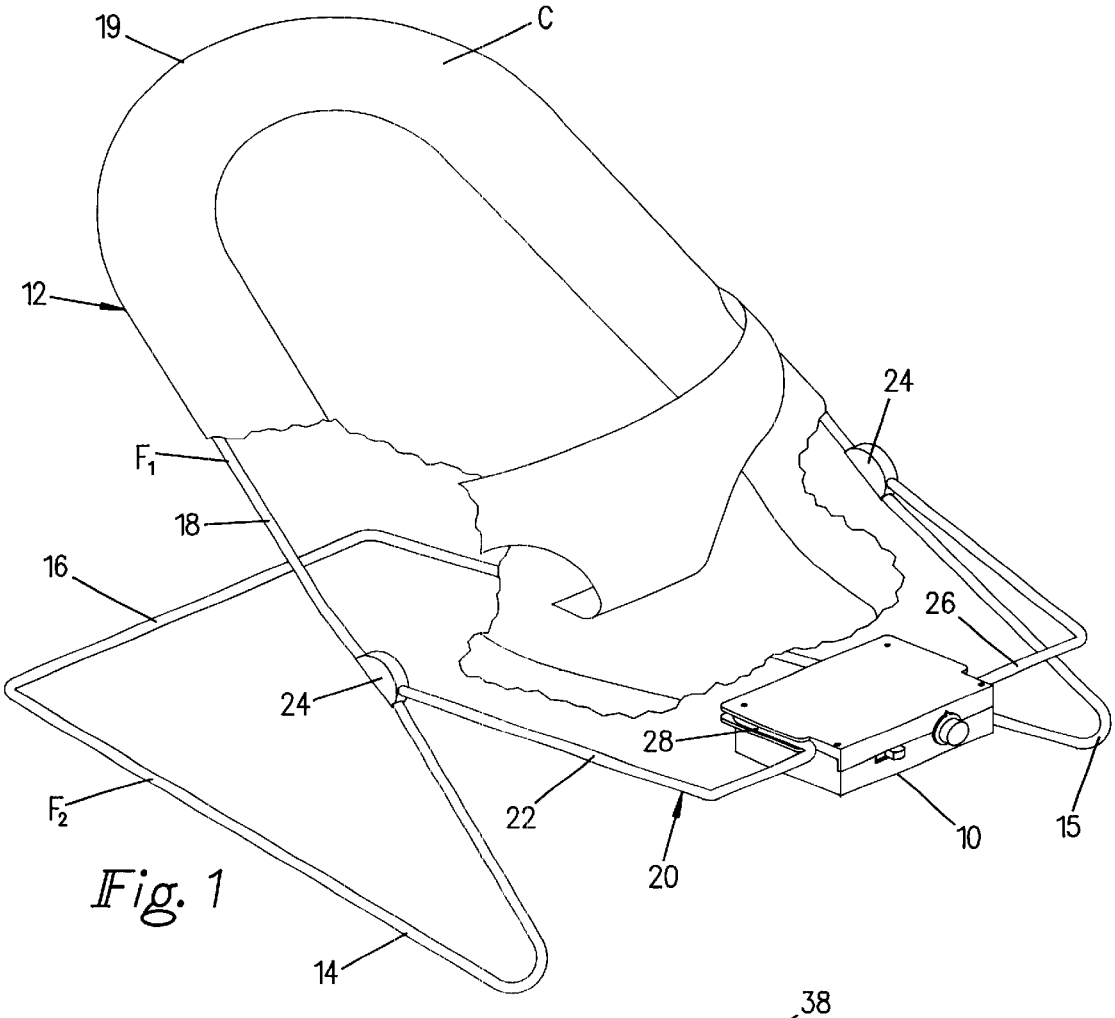
FIG. 1 is a perspective view with portions broken away of a preferred form of vibrational infant seat in accordance with the present invention.
Figure 2:
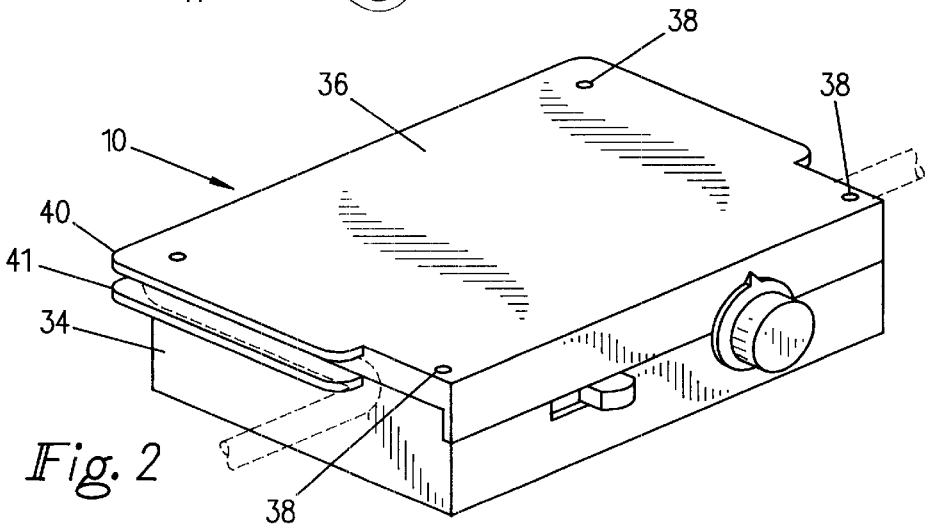
FIG. 2 is an enlarged perspective view of a preferred form of vibrator/bouncer attachment in accordance with the present invention.
Figure 3:
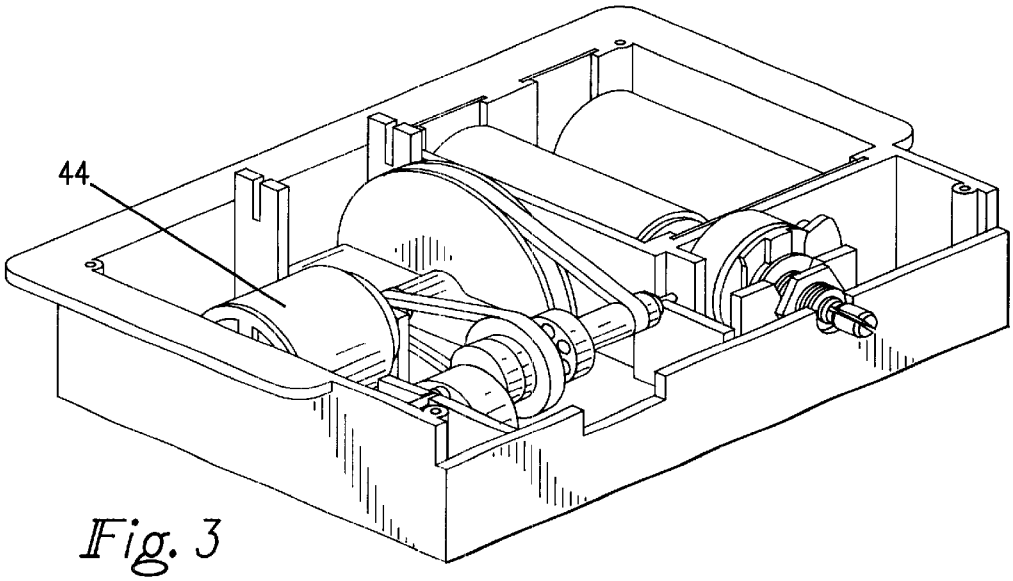
FIG. 3 is a perspective view of the attachment shown in FIG. 2 with the top removed and illustrating the internal components.
Figure 4:
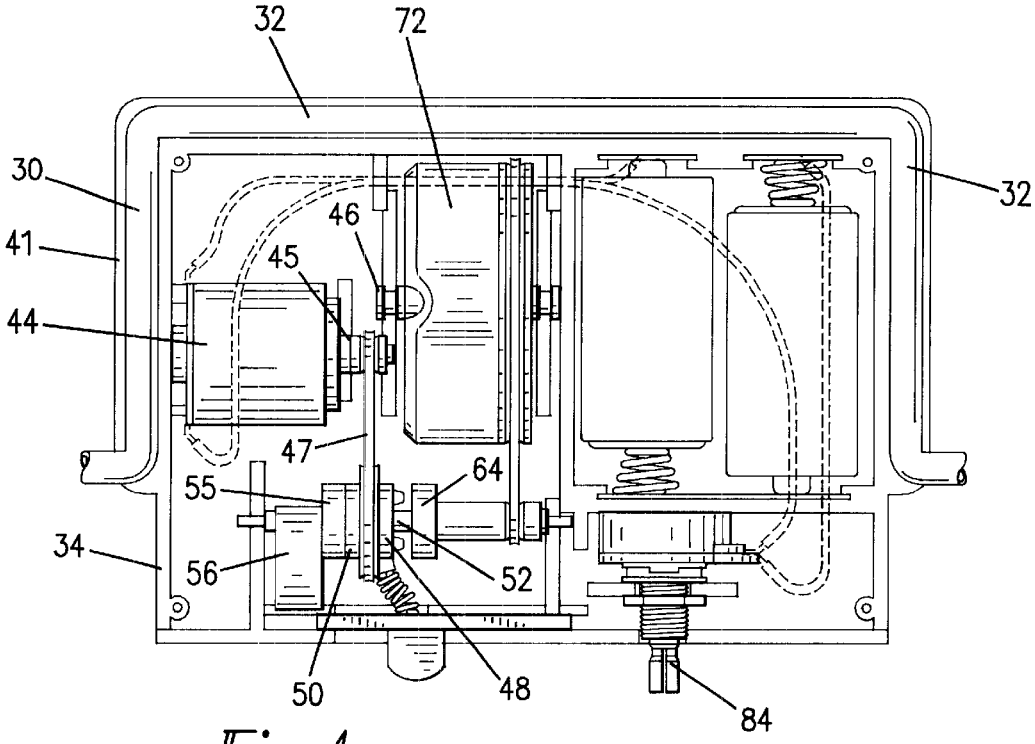
FIG. 4 is a top plan view of the attachment shown in FIGS. 2 and 3 with the top removed.
Figure 5:
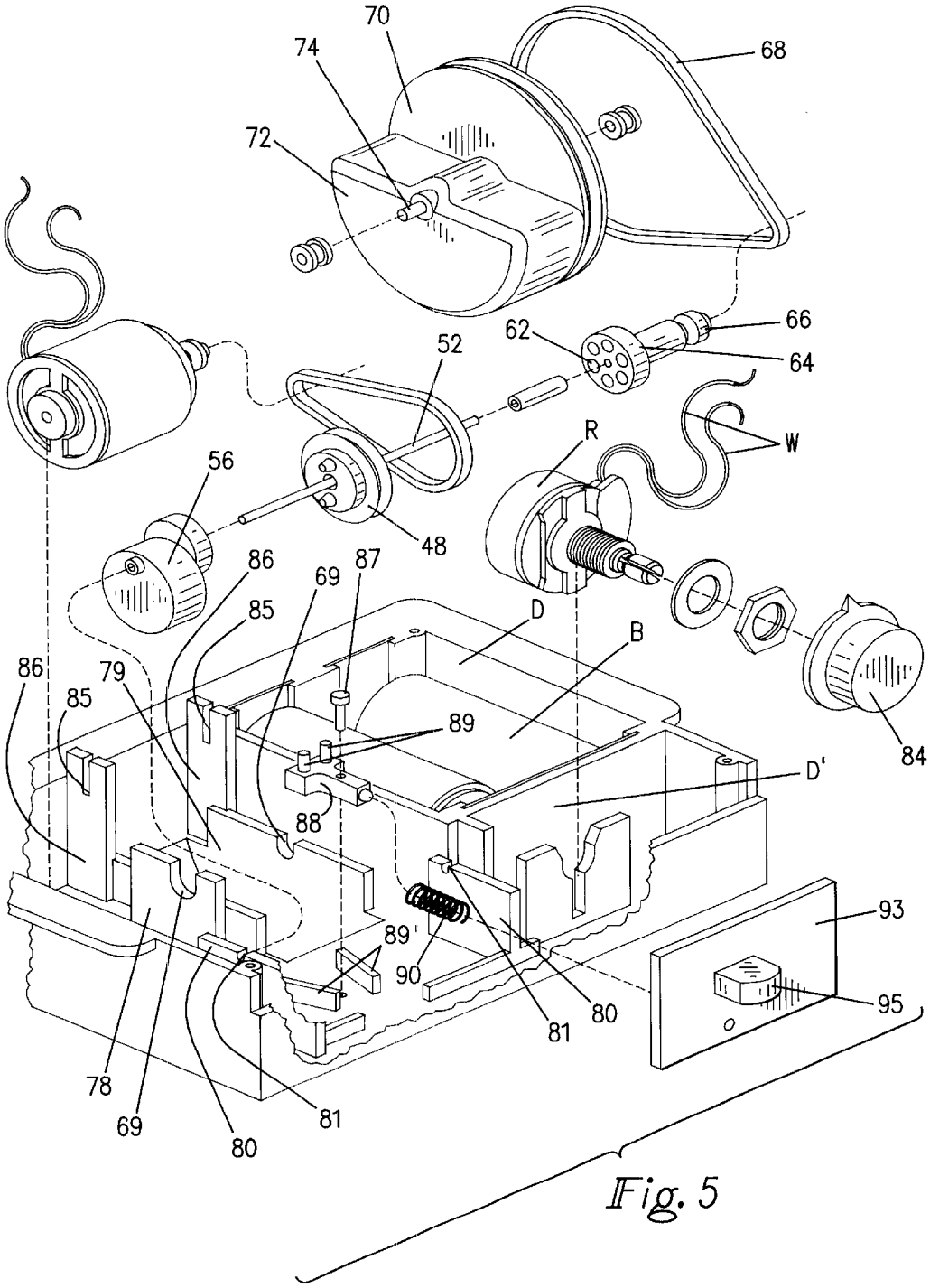
FIG. 5 is an exploded view of the preferred form of attachment with the top removed.
Figure 6:
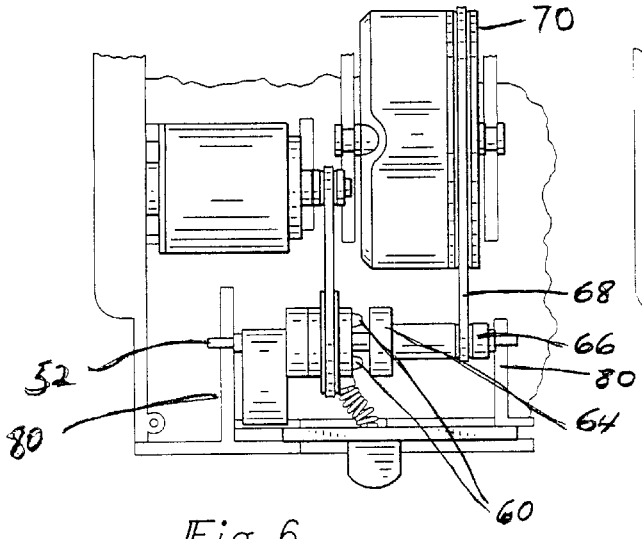
FIG. 6 is a top plan view of the preferred form of attachment in the vibrate position.
Figure 7:
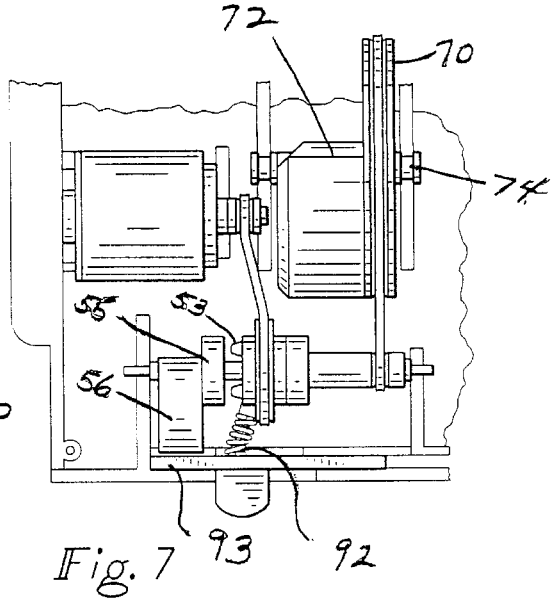
FIG. 7 is a top plan view similar to FIG. 6 illustrating the preferred form of attachment in the bouncer position.
Figure 8:
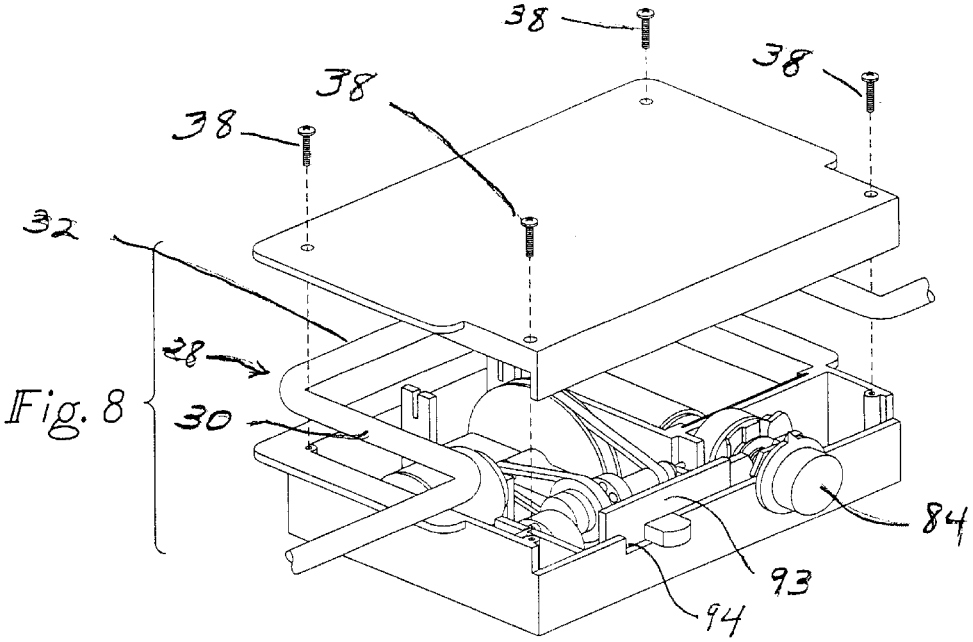
FIG. 8 is an exploded view of the preferred form of attachment and end of an infant seat.

Referring in more detail to the drawings, there is shown in FIGS. 1 and 8 the preferred mounting of a vibrator/bouncer attachment 10 to an infant seat 12. In accordance with conventional practice, the seat 12 is comprised of upper and lower wire frame sections $F_1$ and $F_2$, the latter defining a horizontal ground-engaging base having opposite side members 14 which diverge forwardly from a common cross member 16. Forward ends 15 of the sides 14 are reverse-bent to extend upwardly and rearwardly into the upper wire frame section $F_1$. The upper frame section $F_1$ has side portions 18 inclining downwardly from a common, upper rounded back portion 19, and a leg or foot rest portion 20 is of generally U-shaped configuration having opposite side members 22 rigidly connected to the sides 18 of the upper frame section $F_1$ by coupling members 24. In addition, the closed end of the leg portion 20 is in the form of a cross member 26 having an intermediate offset portion 28 also of generally U-shaped configuration. As best seen from FIG. 8, the offset portion 28 has opposite side portions 30 and a closed end 32 interconnecting the portions 30. A flexible covering C is removably disposed on the upper frame section 18 and leg portion 20 and, as is well-known, infant seats of the type described are designed to permit the upper frame portion 18 and leg portion 20 to spring or vibrate up and down about the reverse bent forward ends 15 when a vertical force is applied to the seat. Such force may be applied manually to the upper frame or through a displacement mechanism affixed to the lower frame, for example, in the manner set forth and described in my co-pending application for patent, Ser. No. 436,697, filed Nov.8, 1999 for BOUNCER SEAT AND DRIVE MECHANISM THEREFOR.

In accordance with the present invention, the preferred form of attachment 10 is a mechanism adapted to be conveniently attached to the offset portion 28 at the front end of the leg portion 20 to impart a vibrational or bouncing motion to the upper frame $F_1$ and which can be amplified by the weight of the infant or baby when placed in the seat 10. For this purpose, the attachment 10 is in the form of a rectangular housing 34 having an upper removable top panel 36 which is secured to the upper open end of the housing by suitable fasteners 38 at the four corners of the housing. Upper and lower spaced flanges 40 and 41 project from three sides of the upper end of the housing and the cover panel 36 so that when the offset portion 28 is positioned between the flange 41 on the upper open end of the housing and the cover panel 28 is tightened onto the housing, the offset portion 28 is clampingly engaged between the flanges.

The mechanism 10 within the housing 34, as shown in more detail in FIGS. 2 to 7, is made up of a motor drive 44 having an output shaft 45 with drive pulley 46 mounted thereon. A timing belt 47 is trained over a groove in the drive pulley 46 to impart rotation to a shiftable driven pulley 48 at a predetermined decrease in speed determined by the relative sizes of the pulleys 46 and 48.

The driven pulley 48 includes a hub 50 which is journaled on a shaft 52. The hub 50 has a pair of diametrically spaced, axially extending drive pins 53 at one end which are engageable with a diametrically opposed pair of a plurality of circumferentially arranged sockets, not shown but corresponding to sockets 62 on hub 64 as hereinafter described, on a hub 55 which carries an eccentric weight 56 thereon. A second pair of diametrically opposed drive pins 60 are mounted on the opposite end of the hub 50 to the drive pins 53 for selective insertion into a diametrically opposed pair of circumferentially arranged sockets 62 in a hub 64 at one end of a drive pulley 66 which is journaled on the shaft 52. An endless timing belt 68 is trained over a pulley 66 and an enlarged driven pulley 70 having an eccentric weight 72, the pulley 70 and weight 72 being journaled on a common shaft 74.

The pulley 48 is selectively shiftable for engagement with one of the hubs 48 and 64 to impart rotation from the motor drive 44 either to the eccentric weight 56, which is relatively lightweight, or to the weight 72 which has a mass that is much larger and heavier than the weight 56.

As a preliminary to describing the shift means for the hub 48, the mechanism 10 is packaged in the compact housing 34 with the motor drive 44 having opposite ends inserted in upper slots 69 of end wall supports 78 and 79. The common shaft 52 for the hub 50 and pulley 48 as well as hub 64 is disposed in slots 81 at upper ends of end support walls 80 directly in front of the motor drive 44. The shaft 74 for the larger eccentric 72 and its attached pulley 70 is disposed in slots (not shown) in end wall 79 and end wall 83.

A power source for the motor drive 44 is preferably in the form of one or more batteries B mounted in a separate compartment D within the housing 34, and a rheostat R is mounted in a separate compartment F in front of the battery compartment D with an adjustable switch control 84 on the front of the housing 28. Wires W extending between the rheostat, battery and motor drive 44 are mounted in slotted ends 85 of posts 86 within the compartment. In a well-known manner, rotation of the switch 84 will regulate the power to the motor drive and the speed of rotation of the pulley 47.

The shift mechanism or shifter for the hub 48 includes a generally T-shaped pivot 88 which is inserted between a pair of fixed side walls 89' and pivotally mounted therebetween on a pin 87 in the bottom wall of the housing 34. A coiled spring element 90 receives the stem end of the pivot 88 at one end and a projection 92 from the inner surface of a slide plate 93 at the opposite end of the spring 90. The projection 92 is mounted on the inner surface of the plate 93 in facing relation to the pivot 88, and the slide plate 93 is inserted within a guide track 96 along the front of the housing 28 with a handle 95 projecting through a slot 94 in the front wall of the housing. A closely spaced pair of pins 89 on the pivot 88 straddle opposite sides of the pulley 48 to shift the pulley 48 in either direction in response to manual shifting of the handle 95.

In practice, the mechanism 10 is mounted at the free end of the foot rest 20 by clamping or sandwiching the offset portion 28 firmly between the upper and lower flanges 40 and 41 of the housing 34. The rheostat control 84 includes an on-off switch to enable the batteries B or other power source to energize the motor 44. Initially, when the motor is turned on at a low speed, the handle 95 for the shift pulley 48 can be grasped to shift the pulley in either axial direction to cause one pair of the pins 53 or 60 to interengage with mating sockets on one of the couplings 55 or 64. When connected to the coupling 55 for the smaller eccentric weight 56, it will be caused to rotate at a relatively high rate of speed by reason of the low ratio step-down in the speed changer or pulley drive between the motor drive 44 and coupling 55. However, when the shifter is advanced in the opposite direction to be coupled through the coupling member 64 to the relatively large and heavy eccentric mass 72, the step-down speed changer between the coupling 64 and eccentric 72 will cause the eccentric to rotate at a relatively low rate of speed with respect to the eccentric 56. The relatively heavy eccentric 72 can be tuned by the rheostat control 84 to be in harmony with the natural frequency of the baby's weight when the baby is positioned in the seat portion. Accordingly, although the speed of rotation of the eccentric weight 72 can be adjusted by the rheostat control 84 it will be much slower than the speed of rotation of the eccentric 56. Further, the amplitude of vibration of the heavier mass 72 is multiplied by applying the vibration to the free end of the foot rest. In this respect, the foot rest acts very much in the manner of a cantilever support beam in maximizing the amplitude of displacement imparted to the frame.

It will be evident that the displacement mechanism can be secured to the seat assembly in ways other than by mounting on the foot rest portion as described; also, the foot rest portion itself or other extension can be connected at different points on the upper frame $F_1$ of the seat assembly. However, the mechanism 10 is particularly effective when mounted on a cantilever-like beam or structure as shown which extends forwardly from a point approximately midway between the upper and lower ends of the upper frame section $F_1$. In this relation, the upper resilient frame $F_1$ also acts very much in the manner of a beam about the lower end of the frame into the base frame $F_2$, particularly when the baby is positioned in the upper portion of the seat and a vibration or bouncing motion is imparted to the frame section $F_1$ above the reverse-curved end portions 15.

It is therefore to be understood that while a preferred form of invention is herein set forth and described, various modifications and changes may be made therein without departing from the spirit and scope of the invention as defined by the appended claims and reasonable equivalents thereof.

I claim:

1. In an infant seat assembly having a floor-engaging base, and an upper frame including a reverse-curved supporting portion extending upwardly from a front portion of said base to merge into an upper inclined back portion, and means extending between said supporting portion and back portion for supporting an infant in a reclined position thereon, the combination therewith comprising:

a displacement mechanism connected to said frame including drive means for imparting a vertically reciprocating motion to said back portion and adjusting means for regulating the frequency of vibration and amplitude of displacement of said frame.

2. In an infant seat assembly according to claim 1 wherein said drive means includes at least one eccentric weight and drive means for rotating said weight.

3. In an infant seat assembly according to claim 2 including a plurality of said eccentric weights each of a different mass, and means for selectively coupling said drive means to one of said weights.

4. In an infant seat assembly according to claim 3 wherein said drive means includes a motor drive and shaft upon which said weights are mounted.

5. In an infant seat assembly according to claim 4 wherein said displacement mechanism is mounted on said back portion of said frame.

6. In an infant seat assembly according to claim 4 wherein a leg rest on said supporting portion includes an offset generally U-shaped portion and means for clamping said mechanism to said offset portion.

7. In an infant seat assembly according to claim 6 wherein said offset portion is at one end of said leg rest opposite to said back portion.

8. In an infant seat assembly according to claim 1 wherein said drive means includes a plurality of eccentric weight members, each of said weight members mounted for rotation independently of the other of said weight members, a motor drive, and means for selectively and drivingly interconnecting said motor drive to one of said eccentric weight members to impart rotation thereto.

9. In an infant seat assembly according to claim 8 wherein said adjusting means is adjustable to match the natural frequency of vibration of said frame when an infant is placed therein.

10. In an infant support device including a resilient frame for supporting an infant thereon, the combination therewith comprising:

a displacement mechanism connected to said frame including drive means for imparting vertical reciprocating movement to said frame, and shift means for shifting said drive means between a first position imparting a high frequency of vibration with low amplitude of displacement and a second position imparting a low frequency of vibration with a high amplitude of displacement to said frame.

11. In an infant support device assembly according to claim 10 wherein said drive means includes at least one eccentrically mounted weight and said drive means imparts rotation to said eccentrically mounted weight(s).

12. In an infant support device assembly according to claim 11 wherein said displacement mechanism includes means for adjusting the frequency of vibration of said frame.

13. In an infant support device according to claim 12 wherein said drive means includes a motor drive and shaft upon which said weight is mounted.

14. In an infant support device according to claim 13 wherein said frame includes a back portion and a mechanism is mounted on a foot rest which is attached to said back portion.

15. In an infant support device according to claim 14 wherein said foot rest includes an offset generally U-shaped portion and said mechanism is clampingly secured to said offset portion.

16. In an infant support device according to claim 15 wherein said offset portion is at one end of said leg rest opposite to said back portion.

17. In an infant support device according to claim 10 wherein said mechanism includes a plurality of eccentric weights of different mass, a motor drive, and means for selectively connecting said motor drive to one of said eccentric weights.

18. An infant seat assembly comprising in combination:

a resilient frame having a base and a front leg rest portion rigidly connected to said frame and extending substantially in a horizontal direction therefrom; and a displacement mechanism mounted at a free end of said leg rest portion including vibrating means for imparting oscillatory motion to said frame, said vibrating means including adjusting means for regulating the frequency of vibration of said frame.

19. An infant seat assembly according to claim 10 said vibrating means including a plurality of eccentric weight members, each of said weight members mounted for rotation independently of the other of said weight members, a motor drive, and means for selectively and drivingly interconnecting said motor drive to one of said eccentric weight members to impart rotation thereto.

20. An infant seat assembly according to claim 19 said motor drive including a step-down speed changer, and said selective connecting means defined by a shift mechanism for selectively interconnecting said speed changer to selected of said eccentric weight members.

21. An infant seat assembly according to claim 20 including a speed reducer for selectively reducing the speed of rotation of a selected one of said eccentric weights.

22. An infant seat assembly according to claim 21 wherein speed adjusting means is provided for regulating the speed of rotation of said motor drive means.

23. In an article of furniture having a floor-engaging base and an upper resilient support portion, the improvement comprising:

a vibrational mechanism drivingly connected to said support portion including means for reciprocating said support portion to impart a vibrating motion thereto, and means for adjusting said vibrational mechanism to correlate its frequency of vibration with the natural frequency of vibration of said support.

* * * * *